United States Patent [19]

Hollyday et al.

[11] Patent Number: 4,674,809

[45] Date of Patent: Jun. 23, 1987

[54] FILTERED TRIAX CONNECTOR

[75] Inventors: Robert D. Hollyday, Elizabethtown; Patrick F. Yeager, Middletown, both of Pa.

[73] Assignee: AMP Incorporated, Harrisburg, Pa.

[21] Appl. No.: 823,924

[22] Filed: Jan. 30, 1986

[51] Int. Cl.[4] ..... H01R 13/66

[52] U.S. Cl. ..... 339/92; 439/63; 439/620; 439/580

[58] Field of Search ..... 339/177 R, 177 E, 14 R, 339/14 P, 17 R, 17 LC, 147 R, 147 P, 143 R

[56] References Cited

U.S. PATENT DOCUMENTS

| | | | |
|---|---|---|---|
| Re. 29,258 | 6/1977 | Fritz | 333/182 |
| 3,832,675 | 8/1974 | Detemple et al. | 339/143 R |
| 4,099,825 | 7/1978 | Jackson | 339/177 E |
| 4,307,926 | 12/1981 | Smith | 339/177 R |
| 4,397,516 | 8/1983 | Koren et al. | 339/177 R |
| 4,598,961 | 7/1986 | Cohen | 339/177 R |
| 4,600,256 | 7/1986 | Anttila | 339/147 R |

FOREIGN PATENT DOCUMENTS

| | | | |
|---|---|---|---|
| 2457248 | 7/1975 | Fed. Rep. of Germany | 339/147 R |
| 2524582 | 1/1976 | Fed. Rep. of Germany | 339/177 R |

*Primary Examiner*—John McQuade

*Attorney, Agent, or Firm*—Katherine A. Nelson

[57] ABSTRACT

A filtered electrical connector having low insertion loss comprises a metal shell having center and intermediate electrical contacts therein, the center contact, intermediate contact and shell being electrically isolated from each other by first and second inner dielectric members; grounded filter members; and impedance members electrically connected in series with the center and intermediate contacts. The impedance members are in inductor and resistor mounted in series to electrical terminals on a circuit board having conductive paths thereon, the circuit board being disposed within the metal shell and in electrical connection with the center and intermediate contact members. The discrete filter network provides an insertion loss to high frequency interference.

26 Claims, 12 Drawing Figures

124
128
126
130
106
110
112
108
116
122
104
96
95
92
91
97
102
100
107
112
94
98
95
93
88
90
86
89
62
63'
68'
64'
69'
24
60
4
42
22
52
4
64
63
68
66
62
78
80
69
74
84
73
82
76
70
77
72
20

22
21
24
26
28
30
32
34
35
36
38
40
34
35'
36'
40'
42
43
44
45
46
48
50
55
58
60

FILTERED TRIAX CONNECTOR

FIELD OF THE INVENTION

This invention relates to electrical connectors and in particular to filtered connectors.

BACKGROUND OF THE INVENTION

In many electrical interconnection applications it is necessary to provide means to protect against loss of transmission signals as well as protect against interference from external noise. The need to protect against loss or interference with transmission signals is particularly acute in the computer and communications industries.

Industry's efforts to control signal interference in the information systems sector have included the use of shielding the computer terminals' internal circuitry with metal and the picture tube with metal mesh screen. This system although effective is relatively expensive.

An object of the present invention is to provide a means for preventing emission of the low frequency electromagnetic radiation from computers or the like.

It is also an object of the invention to provide protection for multiple transmission paths such as a triaxial interconnections.

It is an additional object of the invention to provide an electrical connector that will prevent low frequency radiation losses and in addition be mateable with existing connectors.

It is also an object of the invention to provide a means for protecting electronic equipment that will not require extensive modification of that equipment.

It is a further object of the invention to provide a reliable and cost effective means for protecting electronic equipment.

SUMMARY OF THE INVENTION

The electrical connector of the present invention is comprised of metal shell means having printed circuit board means disposed therein, the board means having conductive path means thereon; electrical terminal means mounted on the board means; dielectric means mounted in and extending along a section of the metal shell means; electrical contact means disposed along and secured in the dielectric means and defining front contact section means and rear contact section means, the rear contact section means being electrically connected with the conductive-path means on the board means; filter means electrically connected with the rear contact section-means and said metal shell means; and impedance means electrically connected in series between the conductive path means and the terminal means.

In accordance with this invention the filter means and the impedance means can be incorporated into the connector without significantly changing the external dimensions or mating configuration of the connector and without changing the positions of the terminals within the connector. Thus, standardization of the connector may be maintained. The mounting means in the preferred embodiment have been changed to provide for rear mounting of the connector to a back panel rather than front mounting so that the filtered connector may be connected to standardized circuit boards in existing equipment.

According to a presently preferred embodiment of the invention, the rear contact section means of the electrical contact means is a pin terminal, the filter means is a tubular filter sleeve mounted on the pin terminal, the sleeve being electrically connected to the metal shell by means of a transverse grounding plate having an aperture therein for receiving said sleeve, and the impedance means comprises an inductor and a resistor.

Further advantages and specific details of the invention will become apparent hereinafter in the following description of the preferred embodiment taken in conjunction with the drawings.

BRIEF DESCRIPTION OF THE FIGURES

FIG. 5 is a cross-sectional perspective view of the subassembly of FIG. 4 taken along line 5—5 of FIG. 4 and mounted within second dielectric body means;

FIG. 6 is a cross-sectional perspective view of the subassembly of FIG. 5 disposed within the outer conductive body prior to attaching rear shell;

FIG. 7 is a cross-sectional perspective view of the assembled connector having a second filter means and cover exploded therefrom;

FIG. 8 is a cross-sectional perspective view of the assembled connector of the present invention;

DETAILED DESCRIPTION OF THE PREFERRED EMBODIMENT

Figure 1:
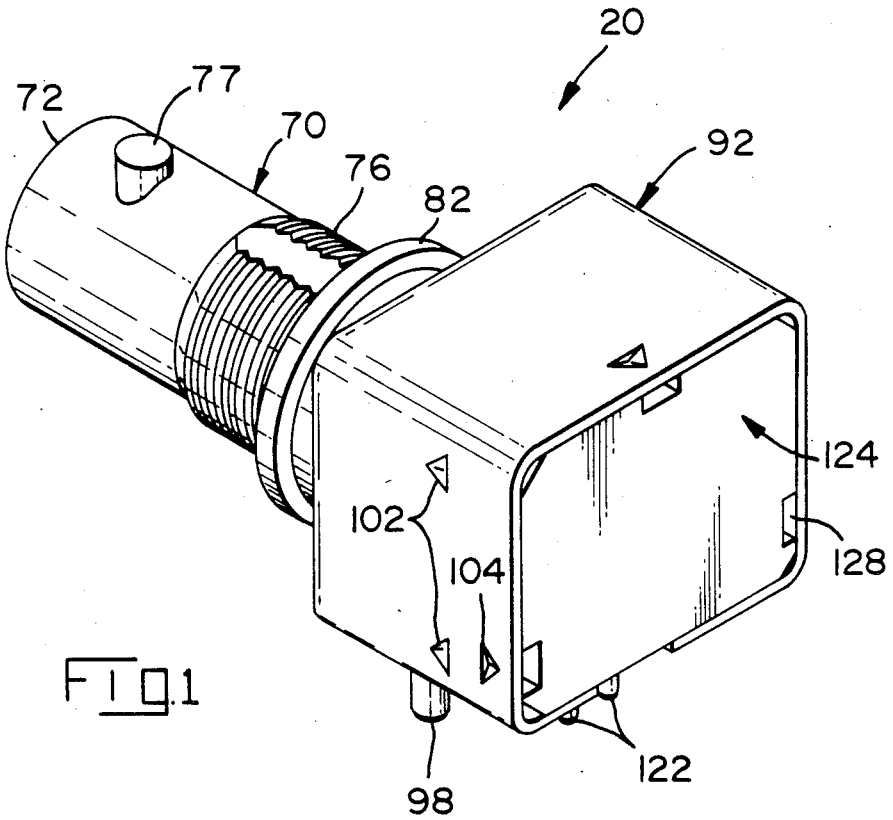
FIG. 1 is a perspective view of the filtered triax connector of the present invention.
Figure 2:
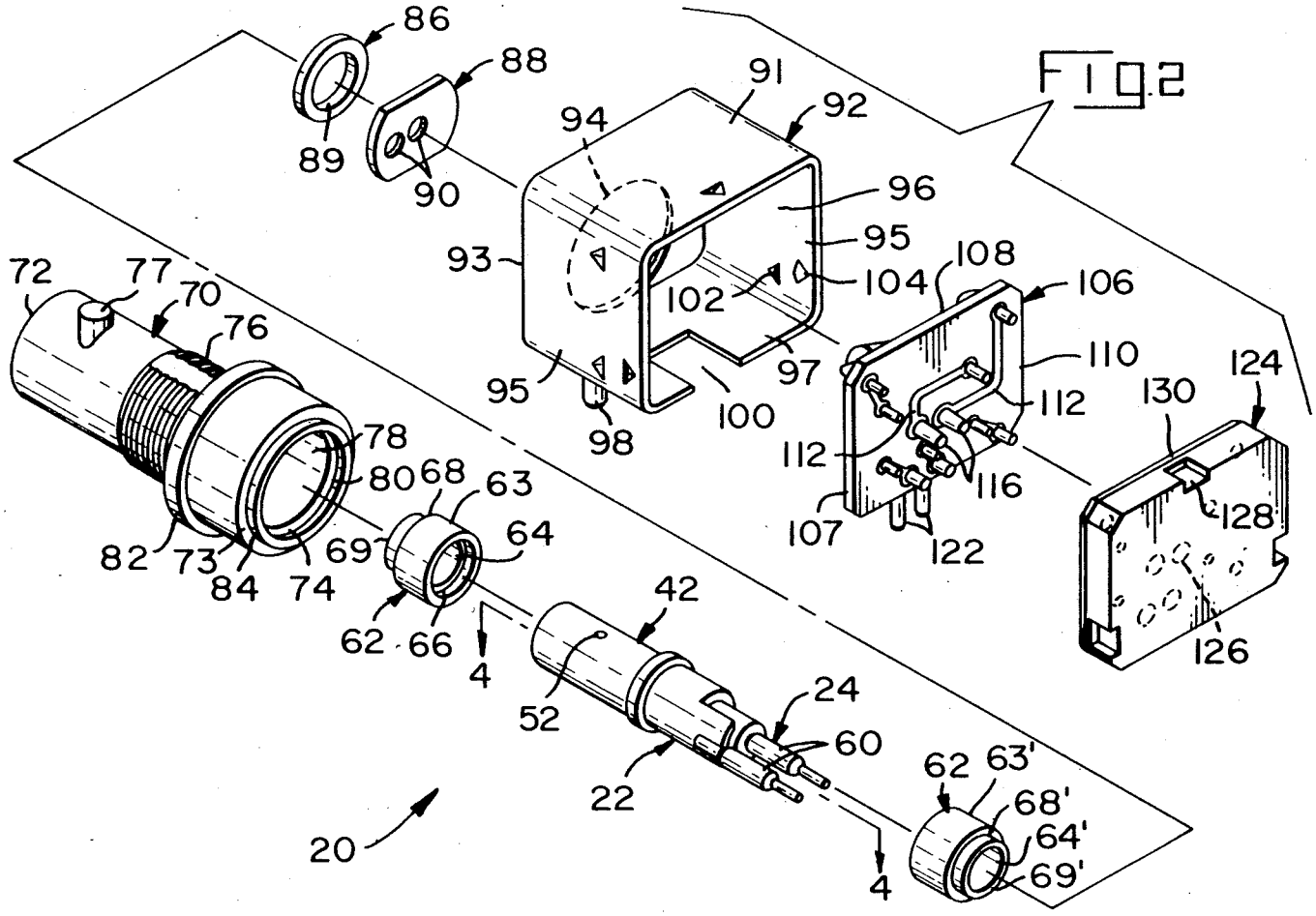
FIG. 2 is an exploded view of the connector of FIG. 1.
Figure 3:
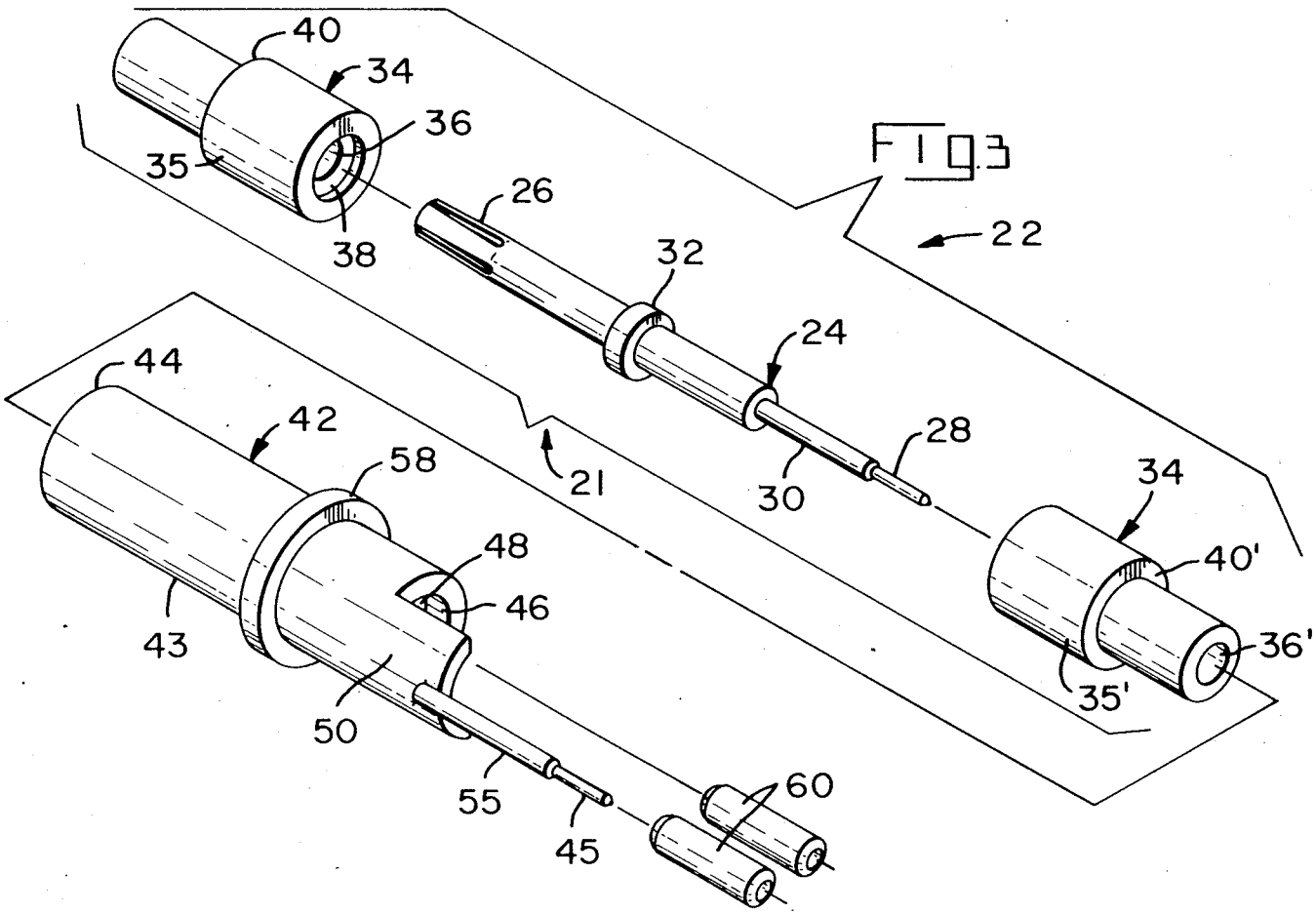
FIG. 3 is an exploded view of the center and intermediate contact subassembly of the connector of FIG. 1.
Figure 4:
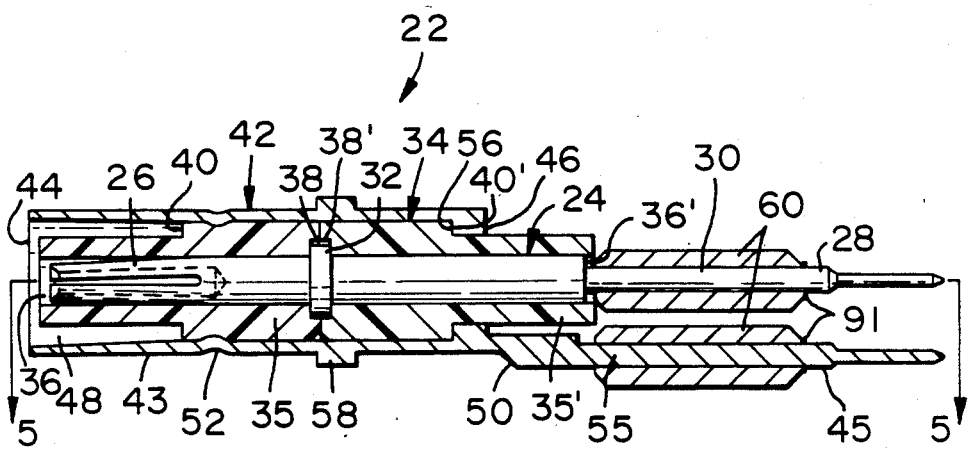
FIG. 4 is a cross-sectional perspective view of the assembled subassembly of FIG. 3 taken along line 4—4 of FIG. 2.

Referring first to FIGS. 1 and 2, filtered triaxial connector 20 is comprised of a center and intermediate contact assembly 22; dielectric means 62; a two-piece conductive outer shell member 70, 92; first filter means 60, grounding means 88, second filter means 106, and cover member 124. As shown in FIGS. 3 and 4, subassembly 22 is comprised of a center contact means 24, first inner dielectric means 34 and intermediate contact means 42. Center contact means 24 has a first connecting portion 26 and a second connecting portion 28, the second connecting portion 28 having section 30 profiled to receive first filter means 60. Center contact means 24 further has annular shoulder means 32 which extends outwardly from center contact means 24. Center contact means 24 can be formed of a variety of conductive materials such as gold plated brass.

Electrical connector 20 comprises a triaxial receptacle connector, and, as is known to those skilled in the art, is adapted to be mated with a complementary plug connector (not shown) to complete electrical circuits through the connector. Extension 77 may be provided on front shell member 70 as shown in FIGS. 1 and 2 to assist in aligning the mating connector.

In the preferred embodiment as best seen in FIGS. 3 and 4 first inner dielectric means 34 is comprised of two identical members 35, 35', each member 35, 35' having a profiled bore 36, 36' respectively therethrough for receiving said first and second connecting portions 26, 28 respectively of the center contact means 24. Each member 35, 35' has an annular recess 38, 38' within bores 36, 36' respectively and at one end thereof. Members 35, 35' are mounted on the first and second connecting portions 26, 28 respectively, such that recesses 38, 38' cooperate with each other and the annular shoulder means 32 to retain the center contact member within members 35, 35' and form subassembly 21. In the preferred embodiment dielectric means 34 is formed of tetrafluoroethylene. Other dielectric materials may also be used.

Each inner dielectric member 35, 35' further has stop surface 40, 40' intermediate its ends formed by an abrupt change in the outside diameter of the inner dielectric member 35, 35'. Stop surface 40, 40' cooperates with positioning means 56 in the intermediate contact means 42 as described later.

Intermediate contact means 42 is comprised of a conductive material having first connecting portion 43, second connecting portion 45, front face 44, back face 46 and profiled bore 48 therethrough for receiving first subassembly 21. Intermediate contact means 42 has an integral wall extension 50 which includes second connecting portion 45, having a section 55 profiled to receive filter means 60 thereon. Intermediate contact means 42 can be formed of a variety of conductive materials such as gold plated brass.

Figure 5:
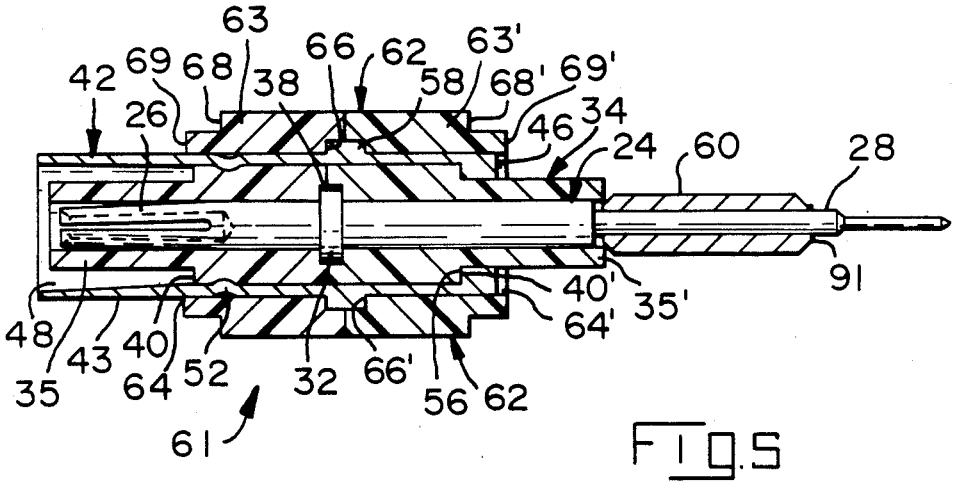
FIGS. 5 to 8 illustrate the steps in assembling the invention.

Subassembly 22 is formed by inserting subassembly 21 inwardly into bore 48 of intermediate contact means 42 from front face 44 until stop surface 40' on rearward first inner dielectric member 35' rests against internal shoulder means 56 in intermediate contact means 42 as is shown in FIGS. 4 and 5. Preferably subassembly 22 is then clinched at 52 to retain subassembly 21 inside intermediate contact means 42.

In the preferred embodiment, filter means 60 comprising filter sleeves are soldered at 91 to profiled sections 30, 55 of second connecting portions 28, 45 of the center and intermediate contact means 24, 42. Alternatively, filter means 60 may be attached to profiled connecting sections 30, 55 prior to inserting subassembly 21 into intermediate contact means 42. Tubular filter elements are well-known devices used extensively in electrical circuits to suppress unwanted interference. They are available in various sizes and capacities, depending on the particular application. Tubular filter elements are typically of the type disclosed in commonly assigned U.S. Pat. No. Re. 29,258. Planar filter means may also be used.

FIGS. 4 and 5 illustrate the relationship between the center conductive means 24 and the intermediate conductive means 42. The FIG. 4 illustrates a cross section taken through the second connecting portions 28, 45 of both center contact means 24 and intermediate contact means 42. FIG. 5 is a cross section taken through the center of subassembly 22 of connector 20 and therefore shows only the center contact means 24. As is shown in these figures, intermediate contact means 42 is spaced from and electrically isolated from center contact means 24 by first inner dielectric means 34.

These figures further show that rearward inner dielectric member 35' extends outwardly from rear face 46 of the second connecting portion 45 of intermediate contact member 42 and that forward inner dielectric member 35 extends axially along and surrounds the first connecting portion 26 of the center contact member 24 thus isolating the center contact means 24 from the intermediate contact means 42. The end of first inner dielectric member 35 is spaced apart from the interior wall of bore 48 to provide space for a complementary mating connector (not shown). In the preferred embodiment the first connecting portions 26 and 43 are shown as socket members and second connecting portions 28, 45 culminate as pin terminals. It is to be understood, however, that other socket and plug configurations may be used.

Intermediate contact means 42 further has an annular shoulder means 58 which cooperates with the second inner dielectric means 62 as is shown in FIG. 5. Second inner dielectric means is comprised of two identical second inner dielectric members 63, 63', each having an inner annular recess 66, 66' and an exterior annular shoulder 68, 68', and bore 64, 64' extending therethrough, as best seen in FIGS. 2 and 5. As is shown in FIG. 5, second dielectric members 63, 63' are mounted on first and second connecting portions 43, 45 of intermediate contact means 42 in second subassembly 22 such that recesses 66, 66' cooperate with each other and annular shoulder extension 58 of intermediate contact means 42 to form third subassembly 61. In the preferred embodiment end 69' of rearward second dielectric member 63' extends slightly beyond the rear face 46 of intermediate contact means 42. The front portion of second subassembly 22 extends outwardly beyond end 69 of forward second dielectric member 63.

Figure 6:
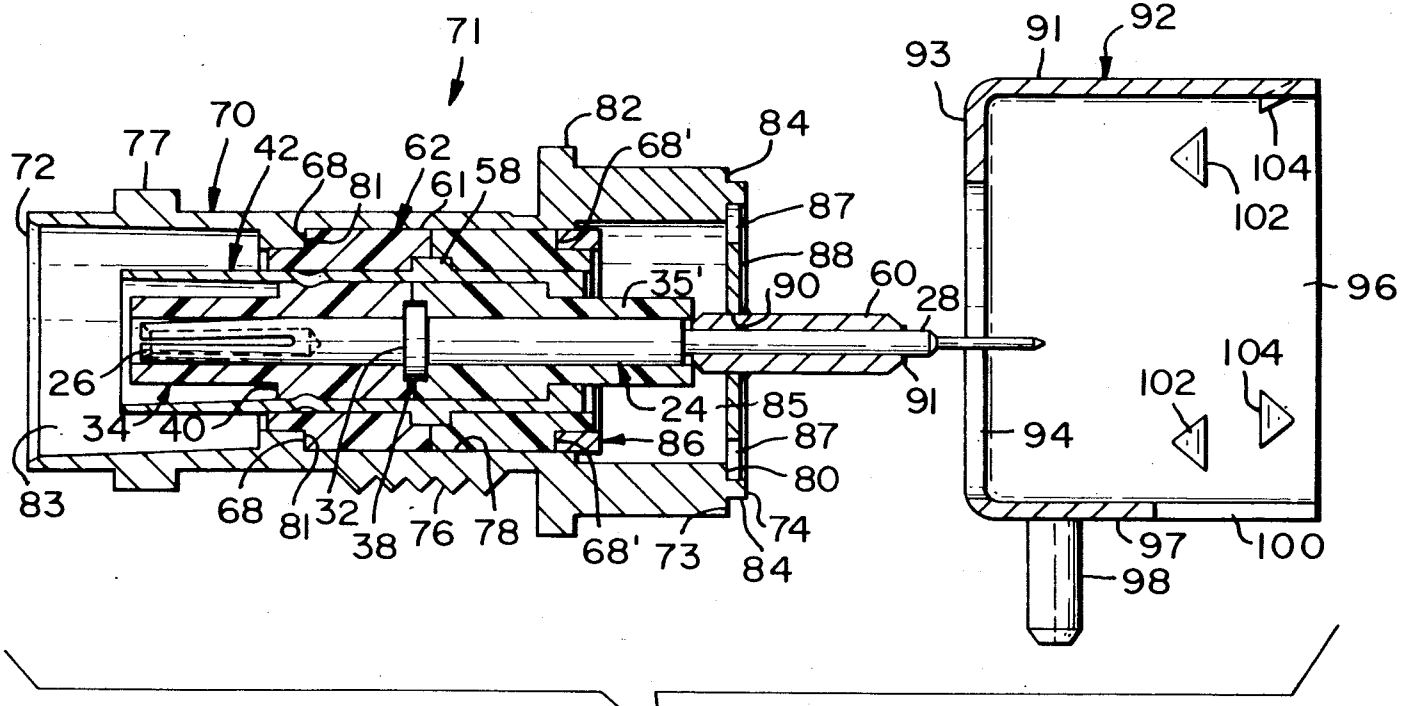

FIG. 6 illustrates a fourth subassembly 71 for connector 20, in which third subassembly 61 is inserted into profiled bore 78 in outer conductive shell member 70 from back end 73 thereof, until annular shoulder 68 of second inner dielectric member 63 rests against internal stop means 81 within the conductive shell 70. Various conductive materials such as tin plated brass may be used for shell member 70. Subassembly 61 is secured within bore 78 by retaining ring 86 having aperture 89 therein as best seen in FIG. 2. Retaining ring 86 is dimensioned to provide an interference fit with shell member 70. Preferably retaining ring 86 is made of same or similar conductive material as shell member 70. The peripheral edge of the ring may be knurled to provide better fitting. Retaining ring 86 is inserted into bore 78 until its rests against annular shoulder 68'.

As is shown in FIG. 6, third subassembly 61 fits into a center portion of the conductive shell 70, thus forming first cavity 83 at the front end of bore 78 and second cavity 85 at the back end of bore 78. The uninsulated portion of intermediate contact means 42 extends into cavity 83 and forms a triaxial socket for mating with a corresponding triaxial plug (not shown). It is to be understood that the configuration of the first connecting portion 26 and the intermediate contact portion 42 may be that of a plug as well as that of a socket. As shown in FIG. 6, second cavity 85 surrounds and extends along first inner dielectric member 35', intermediate contact means 42 and a portion of filter means 60. Circular ring like wall 74 extends rearwardly from rear face 73 of front shell member 70, defining circumferential recess 84 there around and annular recess 80 there within. Annular recess 80 is dimensioned to receive transverse ground plate 88 therein. Ground plate 88 has two apertures 90 therein, as best seen in FIG. 2. Apertures 90 are dimensioned to receive first filter means 60 and be soldered thereto. Ground plate 88 is formed of an electrically conductive material such as cold rolled steel. Preferably ground plate 88 is essentially eliptical in shape as is shown in FIG. 2, so that it only partially fills the rearward end of bore 78; thus forming openings 87 between ground plate 88 and circular wall 74.

Figure 7:
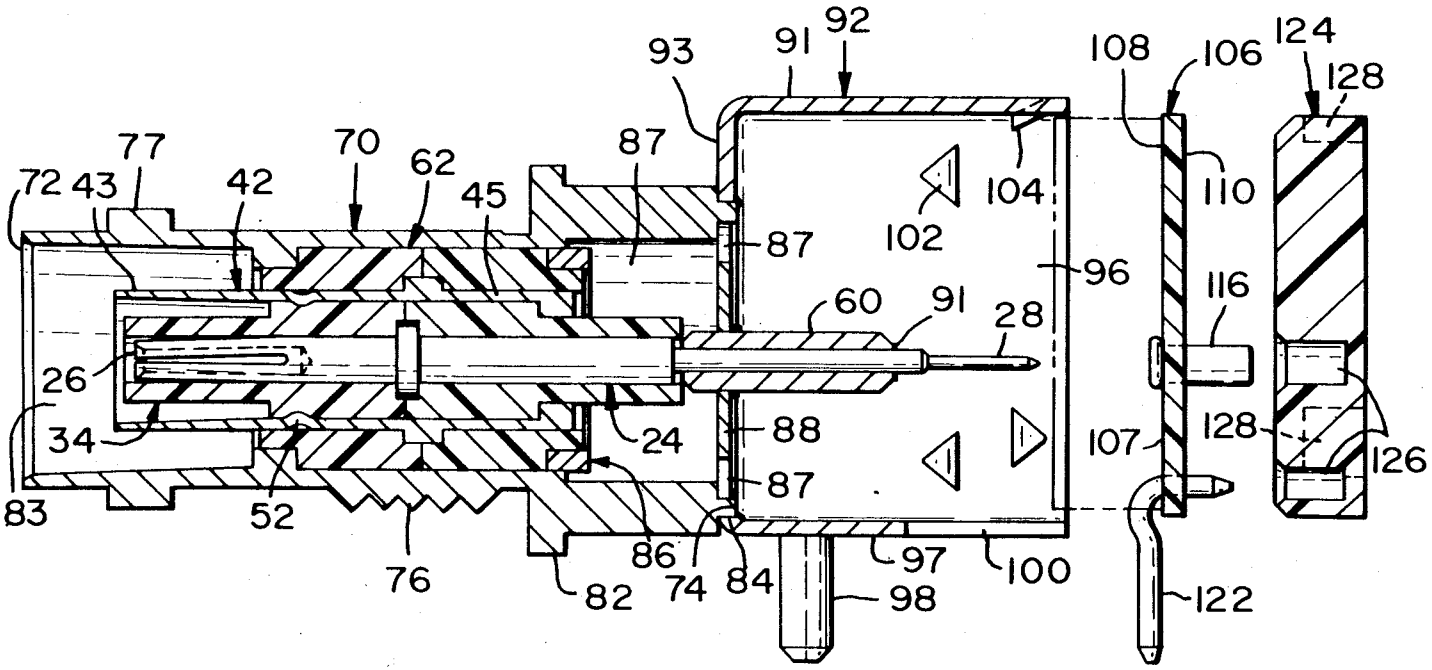

After inserting ground plate 88 into recess 80, front shell member 70 is attached to conductive rear shell member 92. Various conductive materials such as steel may be used for shell 92. As is shown in FIGS. 2, 6 and 7, conductive rear shell member 92 is comprised of top wall 91, front wall 93, and opposing side walls 95 and bottom wall 97 which together define cavity 96. Rear shell member further has alignment legs 98 extending therefrom. Front wall 93 has opening 94 therein dimensioned to receive and securely engage circumferential recess 84 of forth subassembly 71 therein. Slot 100 in bottom wall 97 extends forwardly toward front wall 93 from the cavity opening. A plurality of rearwardly facing stop surfaces 102 and forwardly facing latching means 104 extend into cavity 96 from top and side walls 91, 95. When front and rear shell members 70, 92 have been attached by inserting recess 84 of front shell member 70 into opening 93 of rear shell member 92, they are soldered together to ensure complete mechanical and electrical engagement. Concomitantly therewith, ground plate 88 is soldered to filter means 60 and to annular recess 80 as is shown in FIG. 7. After the soldering has taken place, cavity 85 may be cleaned through access holes 87 to remove excess solder and flux in accordance with known methods such as ultrasonic cleaning and the like.

Figure 8:
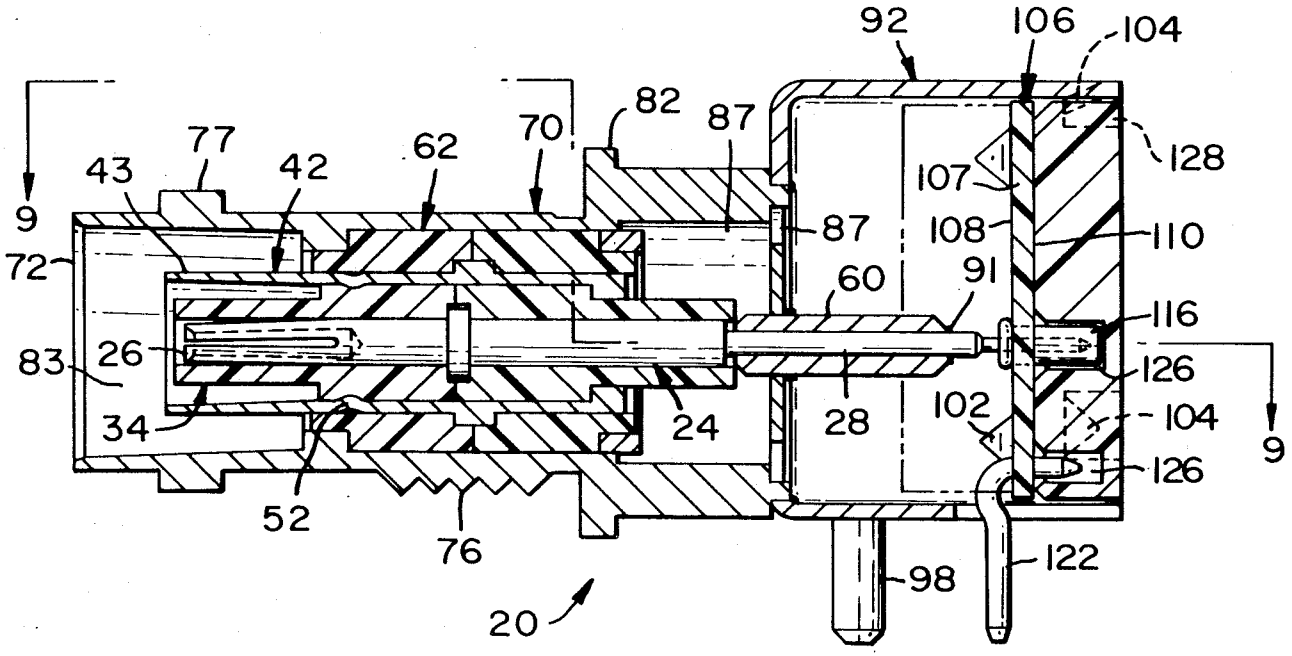
Figure 9:
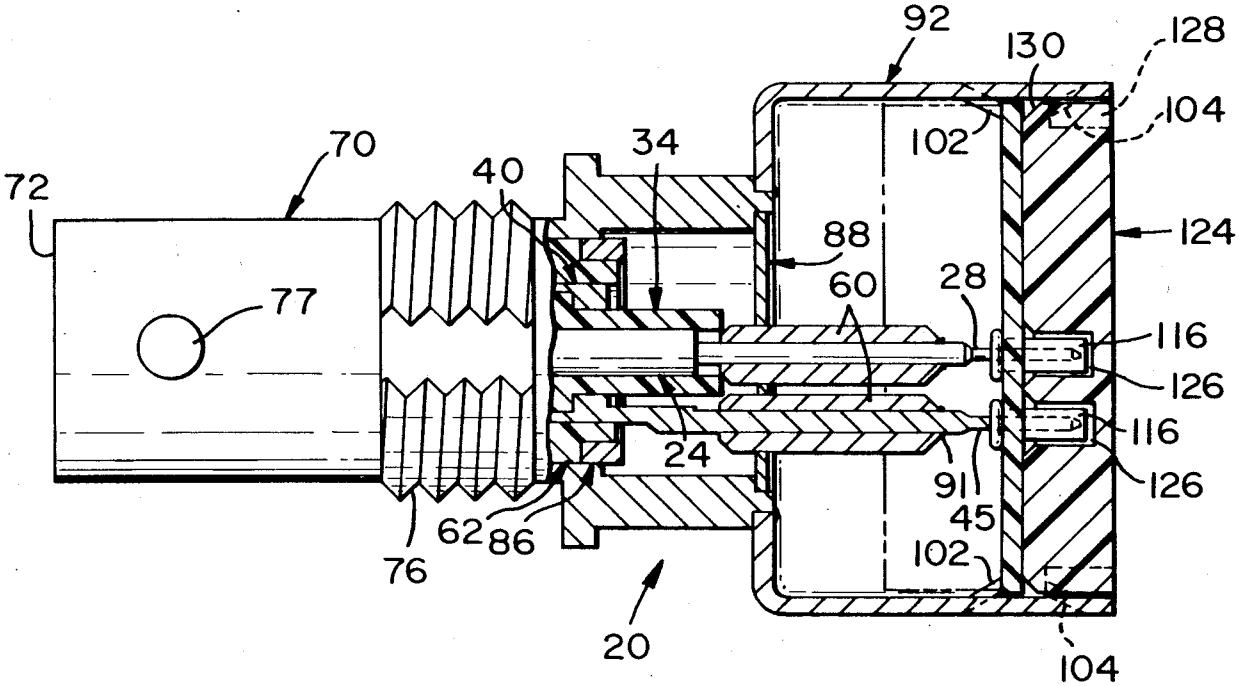
FIG. 9 is a fragmentary cross-sectional perspective view of the connector of FIG. 8 taken on line 9—9 of FIG. 8.
Figure 10:
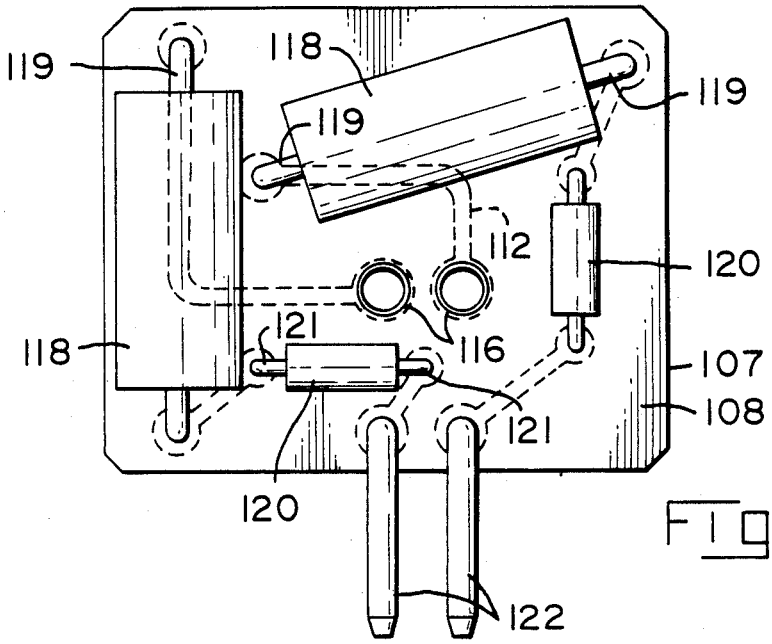
FIG. 10 is a plan view of the front surface of the circuit board assembly used in the present invention.
Figure 11:
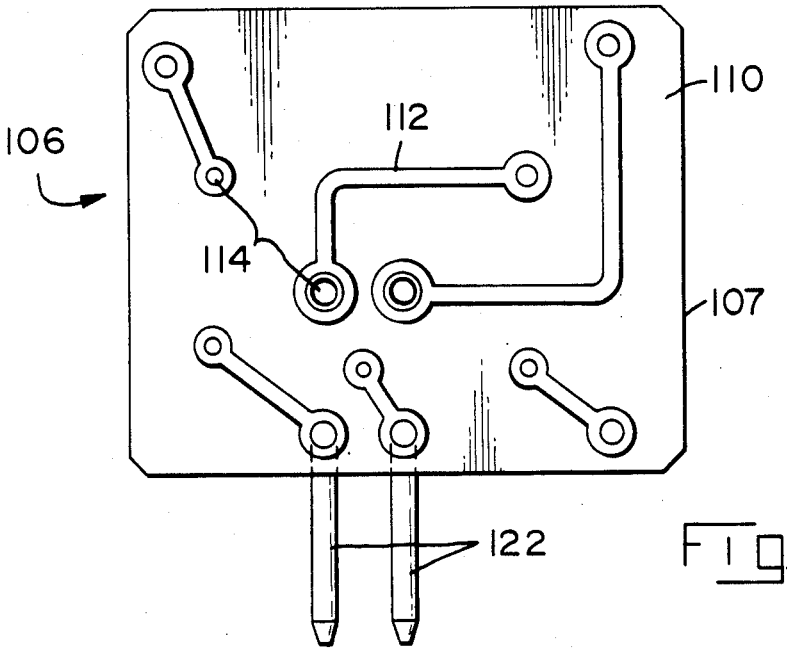
FIG. 11 is a plan view of the rear surface of the circuit board of FIG. 10.

Once conductive shell members 70, 92 have been secured together, second filtering means 106 is inserted into cavity 96 as is best seen in FIGS. 7, 8 and 9. FIGS. 7 and 8 have the same orientation as FIGS. 5 and 6, and FIG. 9 has the same orientation as FIG. 4. Second filtering means 106 as seen in FIGS. 10 and 11, is a circuit board assembly having impedance means mounted on dielectric substrate 107, said substrate having first and second surfaces 108, 110 respectively. As is seen in these Figures, substrate 107 has a plurality of conductive paths 112 on surface 110 thereon and a plurality of apertures 114 extending therethrough to surface 108. As is seen in FIG. 10, impedance means comprises inductors 118 and resistors 120 connected in series by means of conductive paths 112. Inductors 118 and resistors 120 are mounted to substrate 107 by means of leads 119 and 121 respectively, which are inserted into apertures 114 and soldered thereto. Socket terminals 116 and contact pin members 122 are also mounted to substrate 107. Conductive paths 112 connect corresponding socket terminals 116 to a respective inductor 118, resistor 120 and contact pin 122 which extends downwardly from substrate 107.

As is shown in FIGS. 7, 8 and 9, second filter means 106 is inserted into rear shell cavity 96 such that corresponding socket terminals 116 on surface 108 engage corresponding second connecting means 28, 54 of center and intermediate conductors 24, 42 respectively; contact pins 122 are positioned within slot 100 and spaced apart from edges thereof; and surface 108 engages stop surfaces 102. For purposes of clarity, impedance components mounted to substrate 107 are not shown. The broken line indicates the forwardmost position of these components.

Dielectric cover means 124 completes the assembly. Various dielectric materials such as nylon, may be used for the cover means 124, dimensioned to essentially fill the rear opening of cavity 96, has a plurality of recesses 126 extending rearwardly therein, the recesses 126 being arranged in a pattern to receive those portions of leads 119, 121 and socket terminals 116 that extend rearwardly from substrate 107 of second filter means 106 as best seen in FIGS. 2, 7 and 9. Cover member 124 further has a plurality of notches 128 along its peripheral edges, the notches 128 engaging latching means 104 to secure cover member 124 when it is fully seated in rear shell 92. Preferably, the leading edge 130 of cover member 124 is chamfered to assist in inserting it into rear shell member 92.

Figure 12:
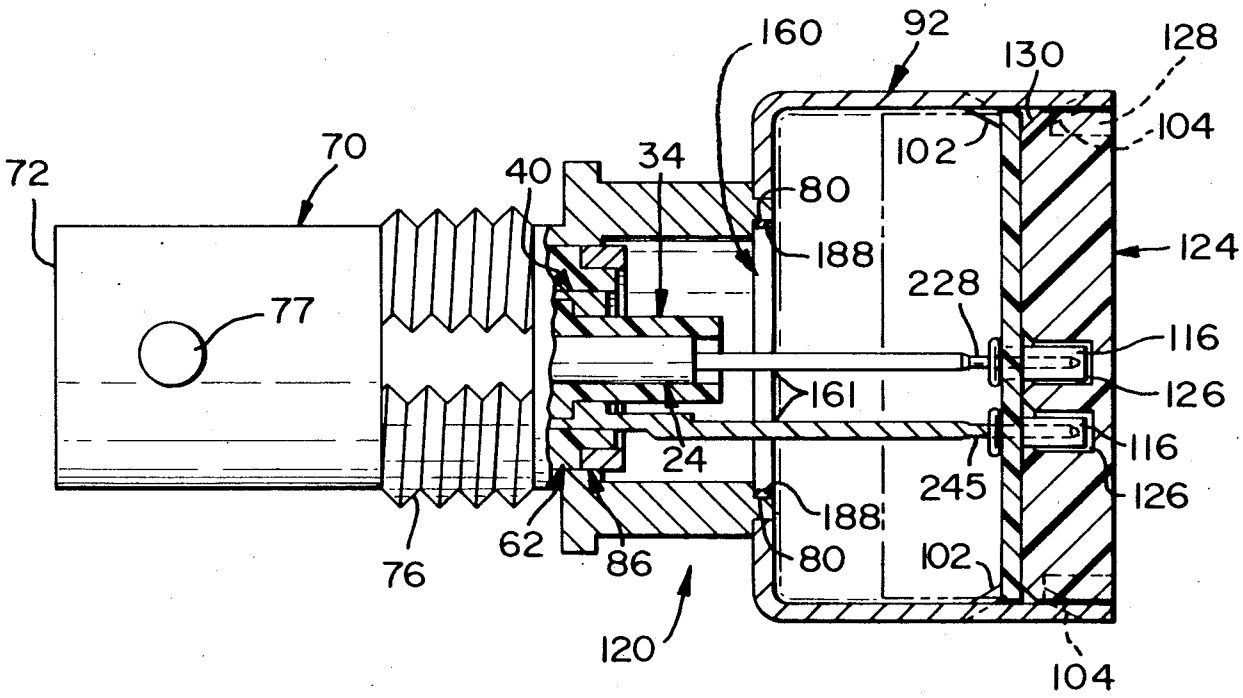
FIG. 12 is a fragmentary cross-sectional view of an alternative embodiment of the connector.

FIG. 12 shows an alternative embodiment 120 of the connector wherein the first filter means is a planar filter member 160 having apertures 161 therein dimensioned to receive second connecting portions 228 and 245, the planar filter member 160 has essentially the same shape as ground plate 88 and is used in lieu of ground plate 88. Grounding of the planar member 160 is effected by providing plating the arcuate portions 188 of the planar member and electrically connecting these portions to the shell by means of solder or the like. Second connecting portions 228 and 245 of center and intermediate contact means are inserted into corresponding apertures 161 and soldered to planar member. Planar member 160 is soldered to recess 80 in the same manner as ground plane 88 is soldered thereto in connector 20.

Electrical connector 20 is designed to be rear mounted to a back panel of a computer or the like. The front end of connector 20 is inserted into the panel (not shown) from the rear, and moved forward until annular mounting extension 82 of front shell 70 rests against the panel, alignment legs 98 are inserted into apertures in circuit board and in electrical engagement with ground conductors, conductor pins 122 are inserted into a circuit board and electrically engaged and corresponding signal circuits. Connector 20 is held in place by mounting means 76 which in the preferred embodiment includes a lock washer and nut. Complementary connector (not shown) is then mated with connector 20 to complete the circuitry. The conductive paths of the signals are through first connecting portions 26 and 42 of center and intermediate contact means 24 and 42 respectively, first filter means 60, second filter means 106 and out of connector 20 through contact pin 122 and into conductors on a circuit board of the equipment (not shown). The ground conductive path is through front shell member 70, rear shell member 92 and through alignment legs 98 to ground circuit within the equipment and to the back panel (not shown) through mounting means 76 and mounting extension 82. The discrete filter network of the present invention extends the insertion loss to much lower frequency ranges than a single filter member.

In the drawings and specification, there has been set forth preferred embodiments of the invention, and although specific terms are employed, they are used in a generic and descriptive sense only, and not for purposes of limitation.

What is claimed is:

1. An electrical connector, comprising:

metal shell means having circuit board means disposed therein, said board means having conductive path means thereon;

electrical terminal means mounted on said board means;

dielectric means mounted in and extending along a section of said metal shell means;

electrical contact means disposed along and secured in said dielectric means and defining front contact section means and rear contact section means, said rear contact section means being electrically connected with said conductive-path means on said board means;

filter means electrically connected with said rear contact section-means and said metal shell means; and impedance means electrically connected in series between said conductive path means and said terminal means.

2. An electrical connector as described in claim 1 wherein said filter means comprises a filter sleeve member having a bore therein in which said rear contact section means of said electrical contact means is disposed.

3. An electrical connector as described in claim 1 wherein said filter means comprises a planar filter member having an aperture therein in which said rear contact section means of said electrical contact means is disposed.

4. An electrical connector as described in claim 1 wherein said impedance means comprises an inductor and a resistor.

5. An electrical connector as described in claim 1 further including a grounding plate having aperture means therein for receiving and electrically engaging said rear contact section means, said grounding plate being in electrical engagement with said shell means.

6. An electrical connector as described in claim 1 wherein said connector further includes mounting means for mounting said connector to a panel.

7. An electrical connector as described in claim 1 further including an inner subassembly comprising: inner dielectric means and inner electric contact means disposed along and secured in said inner dielectric means and defining front contact section means and rear contact section means, said rear contact section means of said inner subassembly being electrically connected with corresponding conductive path means on said board means, said inner subassembly being disposed along and secured within said electrical contact means, said inner electric contact means being spaced from said electrical contact means by said inner dielectric means.

8. An electrical connector as described by claim 7 wherein said inner rear contact means is electrically connected to said filter means and said metal shell means.

9. An electrical connector as described in claim 8 wherein said filter means comprises filter sleeve members having a bore therein in which said rear contact sections of said electrical contact means and said inner contact means are disposed.

10. An electrical connector as described in claim 8 wherein said filter means comprises a planar filter member having apertures therein in which said rear contact sections of said electrical contact means and said inner contact means are disposed.

11. An electrical connector as described in claim 7 wherein said impedance means comprises an inductor and a resistor.

12. An electrical connector as described in claim 7 further including a grounding plate having aperture means therein for receiving and electrically engaging said filter means on rear contact section means and said inner rear contact section means, said grounding plate being in electrical engagement with said shell means.

13. An electrical connector as described in claim 1 further including means for retaining said dielectric means and said electrical contact means within said metal shell means.

14. An electrical connector as described in claim 6 further including means for retaining said dielectric means and electrical contact means within said metal shell means.

15. An electrical connector as described in claim 13 further including mounting means for mounting said connector into a panel.

16. An electrical connector as described in claim 15 wherein said mounting means provides a grounding path for said connector.

17. An electrical connector comprising:

first interior dielectric means having a profiled bore extending therethrough;

center contact means disposed within said profiled bore forming a first subassembly, said center contact means having first and second connecting portions;

intermediate contact means having a profiled bore therethrough in which said first subassembly is disposed forming a second subassembly, said intermediate contact means having first and second connecting portions and being spaced from and electrically insulated from said center contact means by said first inner dielectric means;

second interior dielectric means having a profiled bore therethrough in which said second subassembly is disposed forming a third subassembly;

exterior conductive body member having a profiled bore therethrough in which said third subassembly is disposed;

means for retaining said third subassembly within said exterior conductive body member;

first filter means for respective second connecting portions of said center contact means and said intermediate contact means and in electrical engagement therewith;

second filter means for respective second connecting portions of said center contact means and said intermediate contact means and in electrical engagement therewith; and grounding means in electrical engagement with said first filter means.

18. An electrical connector as described in claim 17 wherein said first filter means comprises filter sleeve members having a bore therein in which respective second connecting portions of said center and intermediate contact means are disposed.

19. An electrical connector as described in claim 17 wherein said first filter means comprises a planar filter member having apertures therein in which respective second connecting portions of said center and intermediate contact means are disposed.

20. An electrical connector as described in claim 17 wherein said second filter means comprises an inductor and a resistor.

21. An electrical connector as described in claim 17 further comprising circuit board means disposed within said exterior conductive body member; said board means having conductive path means thereon.

22. An electrical connector as described in claim 21 wherein said second filter means is disposed on said board means and electrically connected in series between said conductive path means and said second connecting portions of said center and intermediate contact means.

23. An electrical connector as described in claim 22 wherein said second filter means comprises an inductor and a resistor.

24. An electrical connector as described in claim 18 wherein said grounding means comprises a grounding plate having apertures therethrough for receiving and electrically engaging said first filter means, said grounding plate being in electrical engagement with said exterior conductive body member.

25. An electrical connector as described in claim 17 further including mounting means for mounting said connector to a panel.

26. An electrical connector as described in claim 25 wherein said mounting means provides a grounding path for said connector.

* * * * *